US007634965B2

(12) United States Patent
Ambrico

(10) Patent No.: US 7,634,965 B2
(45) Date of Patent: Dec. 22, 2009

(54) PYROTECHNIC DEVICE WITH IGNITION DELAY

(76) Inventor: Francesco Ambrico, Le Clair Vallon, 38160 Saint Marcellin (FR)

( * ) Notice: Subject to any disclaimer, the term of this patent is extended or adjusted under 35 U.S.C. 154(b) by 400 days.

(21) Appl. No.: 10/512,898

(22) PCT Filed: Apr. 29, 2003

(86) PCT No.: PCT/FR03/01355

§ 371 (c)(1),
(2), (4) Date: Jul. 18, 2005

(87) PCT Pub. No.: WO03/095934

PCT Pub. Date: Nov. 20, 2003

(65) Prior Publication Data

US 2006/0150856 A1 Jul. 13, 2006

(30) Foreign Application Priority Data

Apr. 29, 2002 (FR) ..... 02 05384

(51) Int. Cl.
*C06C 5/04* (2006.01)
*C06C 5/06* (2006.01)

(52) U.S. Cl. ..... 102/275.7; 102/275.1; 102/275.6

(58) Field of Classification Search ..... 102/275.1, 102/275.2, 275.3, 275.4, 275.5, 275.6, 275.7, 102/275.8
See application file for complete search history.

(56) References Cited

U.S. PATENT DOCUMENTS 2,239,052 A * 4/1941 Pearsall et al. ..... 102/275.1
3,306,201 A * 2/1967 Noddin ..... 102/275.3
3,651,760 A 3/1972 Held
3,734,019 A * 5/1973 Rentz et al. ..... 102/275.6
3,762,267 A * 10/1973 Travor et al. ..... 89/1.14
4,282,814 A * 8/1981 Menz et al. ..... 102/318
4,495,867 A * 1/1985 Mitchell et al. ..... 102/275.4
4,539,909 A * 9/1985 Day et al. ..... 102/275.2
4,714,017 A 12/1987 Kelly et al.
5,327,835 A * 7/1994 Adams et al. ..... 102/275.11
5,398,611 A * 3/1995 Michna et al. ..... 102/275.7
6,318,271 B1 * 11/2001 Clark ..... 102/275.7
6,515,570 B2 * 2/2003 Kaltenborn et al. ..... 337/290
6,880,465 B2 * 4/2005 Badger et al. ..... 102/275.7
7,188,566 B2 * 3/2007 Gladden ..... 102/275.11

FOREIGN PATENT DOCUMENTS

FR EP 1 079 200 A1 2/2001

* cited by examiner

*Primary Examiner*—David J Parsley
(74) *Attorney, Agent, or Firm*—Howard IP Law Group, PC

(57) ABSTRACT

A pyrotechnic device having an ignition delay between a fuse or igniter and a device to be ignited, including a first element which defines a first space that houses at least one fuse or igniter, and a second element which communicates with a second space that houses the device to be ignited, moreover, the device includes a track containing an evenly burning flammable material, which is in permanent contact with the first space by a connecting portion of the first space and with the second space by an opening. The first element can slide in relation to the second element and/or vice versa such as to alter the length of the track between the connecting portion and the opening, in order to modify the duration of the ignition delay.

10 Claims, 3 Drawing Sheets

PYROTECHNIC DEVICE WITH IGNITION DELAY

This application is the national stage application under 35 U.S.C. § 371 of the International Application No. PCT/FR03/01355 and claims the benefit of French Application No. 02/05384, filed Apr. 29, 2002 and Int'l. Application No. PCT/FR03/01355, filed Apr. 29, 2003, the entire disclosures of which are incorporated herein by reference in their entireties.

The present invention relates to the field of pyrotechnics.

When fireworks are desired to be fired, it is desired to minimize the number of ignitions of individual pyrotechnical pieces, such as rockets, light fountains, candles, etc. Thus, the various pyrotechnical pieces, for example, rockets placed in mortars, are connected in clusters, that is, the fast fuse of each piece is connected to another fuse directly or via a pyrotechnical delay, itself connected to another fuse directly or via a pyrotechnical delay, itself connected to another fuse, to another delay, etc., up to a point at which an electric igniter is connected. It would perhaps be simpler to directly connect each fuse of each pyrotechnical piece to a specific igniter and, by an electronic circuit, to control the ignition time of each piece. However, in practice, this appears to be much too expensive and it is preferred to use the traditional system with fuses and pyrotechnical delays.

The delay devices are of various types. They will be, for example, safety fuses or Bickford cords. However, more generally, delays formed of powder compacted in a cardboard cylinder are used since it is currently the least expensive device.

The above delay devices have the disadvantage that they do not enable achieving any delay time. It is generally admitted that, with current powders, the length of the cardboard cylinder sets the duration of the delay, which is on the order of one second per centimeter. In practice, it is difficult to obtain relatively accurate delays of a duration shorter than 2 seconds or longer than from 5 to 6 seconds. Otherwise, it must be passed to safety fuses of Bickford fuse type, which are much more expensive.

Patent EP 1079200 describes a pyrotechnical device of delay between fuses and/or between igniter and fuses enabling selection of a delay of a determined duration selected from among several predetermined delays.

The present invention provides a pyrotechnical device having the same object as the device of patent EP 1079200 but which is particularly simple and economical to industrialize.

The present invention also provides a pyrotechnical delay device enabling varying in continuous fashion the value of the delay selected from a continuous range.

To achieve these objects, the present invention provides a pyrotechnical device of ignition delay between a fuse or an igniter and a device to be ignited, comprising a first element defining a first space receiving at least one fuse or one igniter; and a second element communicating through an orifice with a second space receiving the device to be ignited, the device comprising a track containing a regularly-burning flammable material, formed at the level of the surface of the first and/or of the second element, and permanently communicating with the first space through a communicating portion of the first space and with the second space through the orifice, the first element being able to slide with respect to the second element and/or conversely to modify the track length between the communicating portion and the orifice to modify the duration of the ignition delay.

According to an embodiment of the present invention, the second element is a body comprising a recess forming the second space and an opening in which is shiftably assembled the first element, the first element comprising a chamber forming the first space, the second space communicating with the opening through the orifice.

According to an embodiment of the present invention, the recess forming the second space is arranged laterally to the opening, the track being formed of a groove filled with the flammable material arranged on the external wall of the first element, the groove communicating at one end with the chamber through a hole and being placed opposite to the orifice.

According to an embodiment of the present invention, the recess forming the second space is arranged in prolongation of the opening and the track is formed of a first groove filled with the flammable material arranged on the external wall of the sliding system, the first groove communicating at one end with the chamber through a hole, and of a second groove filled with the flammable material arranged on the inner wall of the opening and communicating at one end with the second space through the orifice, the first groove being placed opposite to the second groove.

According to an embodiment of the present invention, inscriptions are made on the external wall of the first element, the body comprising a port emerging on the opening and exposing part of the inscriptions as the first element moves in the opening.

According to an embodiment of the present invention, the chamber can further be rotated with respect to the element.

According to an embodiment of the present invention, the first element and the second element are at least partly parallelepipedal and are shiftably assembled with respect to each other, a planar surface of the first element at least partially facing a complementary planar surface of the second element, the track being formed of at least one rectilinear groove filled with the flammable material arranged on the planar surface or the complementary planar surface.

According to an embodiment of the present invention, the device comprises a carriage, comprising a chamber defining the first space, said carriage being capable of sliding in rails arranged on the wall of a casing containing the second space, the orifice crossing the casing wall, the track being formed of at least one groove formed on the carriage, containing the flammable material and communication through a hole with the chamber and connected to the orifice.

According to an embodiment of the present invention, the device to be ignited is an enclosure containing a combustion material, and the second element comprises a wall crossed by the orifice and intended to be attached to the enclosure, the first element being formed of a carriage, comprising a chamber forming the first space, capable of sliding in rails arranged on the wall on the side opposite to the enclosure, the track being formed of at least one groove formed on the carriage, containing the flammable material and communicating through a hole with the chamber and connected to the orifice.

According to an embodiment of the present invention, the device to be ignited is an enclosure containing a combustion material, and the second element comprises a fixed plate, crossed by the orifice and intended to be attached to the enclosure, the first element comprising a mobile plate rotatably assembled on the fixed wall on the side opposite to the enclosure, the mobile plate comprising an opening forming the first space, the track being formed of at least one at least partly circular groove, containing the flammable material, formed on the fixed plate on the side opposite to the enclosure, prolonging by the orifice, and having a portion communicating with the opening.

The foregoing and other objects, features, and advantages of the present invention will be discussed in detail in the following non-limiting description of specific embodiments in connection with the accompanying drawings, among which:

FIGS. 1 to 3 show views of a first embodiment of a delay device 10 according to the present invention. FIG. 4 more specifically shows a specific element of the first embodiment of device 10 according to the present invention.

Figure 1:
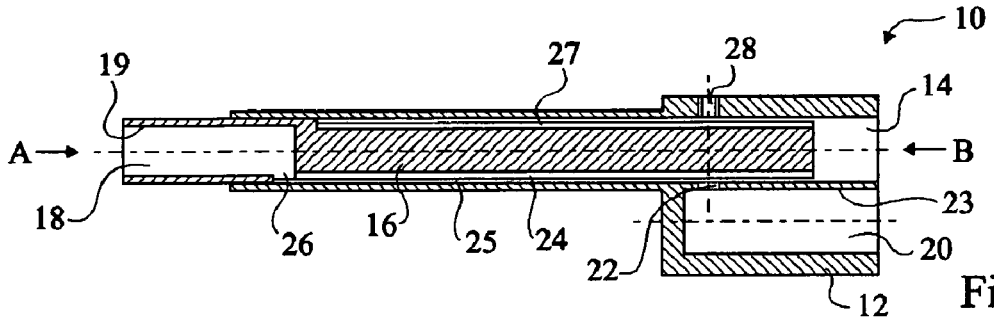
FIG. 1 shows a cross-section view of a first embodiment of the present invention.
Figure 2:
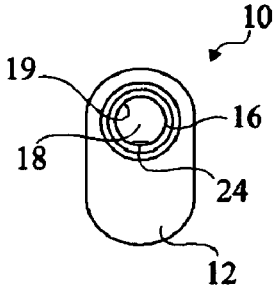
FIG. 2 shows a view of the device of FIG. 1 along direction A.
Figure 3:
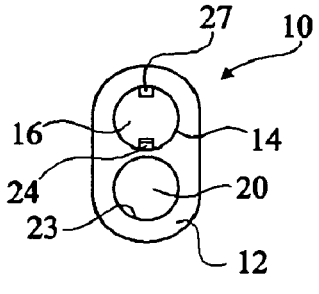
FIG. 3 shows a view of the device of FIG. 1 along direction B.
Figure 4:
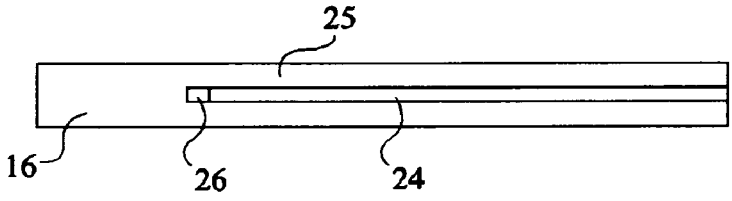
FIG. 4 shows a specific element of the device of FIG. 1.

Device 10 is formed of a guide 12 crossed by a cylindrical opening 14 in which a cylindrical sliding system 16 can slide. Preferably, sliding system 16 and guide 12 may be molded parts of plastic matter, or machined parts of a metallic material, or may combine metal and plastic materials. The external diameter of sliding system 16 substantially corresponds to the inner diameter of opening 14.

Sliding system 16 comprises, at one end a cylindrical chamber 18 having its internal walls 19 coated with a very flammable material, preferably a material very easily igniting inside of a chamber. This material is for example compacted black powder. Chamber 18 is intended to receive the end of one or of several fuses (not shown) or of one or several igniters.

Guide 12 also comprises a cylindrical chamber 20 having an axis parallel to the axis of opening 14 and arranged laterally to opening 14 at the level of an end thereof. Chamber 20 communicates with opening 14 through a cylindrical orifice 22. Internal walls 23 of chamber 20 are coated with a very flammable material similarly to internal walls 19 of chamber 18. Chamber 18 is intended to receive the end of one or several fuses (not shown).

Means (not shown) for holding the fuses or the igniters are arranged at the level of chambers 18, 20. Such means are for example formed of pierced caps. The wall of sliding system 16 at the level of chamber 18 may also be sufficiently flexible to be deformed by a tool to block the fuse(s).

A combustion track is formed on sliding system 16 and is formed of a rectangular groove 24 filled with a flammable material and extends along external wall 25 of cylindrical system 16 substantially along a generatrix. Groove 24 emerges at one end 26 into chamber 18 and extends to the opposite end of sliding system 16. The flammable material enables, when it is ignited at one end of groove 24, propagating a flame to the other end of groove 24 at a substantially constant speed. It will be, for example, compacted black powder or a specific fuse such as a thin safety fuse manufactured by Bickford Company. Openings (not shown) are provided, for example at the level of guide 12, to enable carrying off the gases resulting from the combustion of the flammable material arranged in groove 24.

A rectangular guiding groove 27 extends along external wall 25 of cylindrical sliding system 16 substantially along a generatrix. Guiding groove 27 is substantially arranged in diametrically opposite fashion to the combustion track with respect to the axis of sliding system 16. Guiding groove 27 is intended to receive the end of a guide track (not shown) screwed in a threaded hole 28 of guide 12.

When sliding system 16 has penetrated into opening 14, guiding groove 27 cooperates with the guiding screw so that the combustion track faces orifice 22. According to the depth of the penetration of sliding system 16 into opening 14, the length of the combustion track separating end 26 from orifice 22 varies.

When the fuse arranged in chamber 18 is ignited, or when the igniter arranged in chamber 18 is actuated, a flame propagates within chamber 18 and results in the very fast ignition of the powder arranged on internal walls 19 of chamber 18. The flame thus generated propagates to end 26 of groove 24 communicating with chamber 18 and ignites the flammable material at end 26 of the combustion track. The combustion of the material propagates along the combustion track until the flame reaches orifice 22. The powder which coats internal walls 23 of chamber 20 ignites, causing the ignition of the fuse(s) arranged in chamber 20.

Since the propagation speed of the combustion of the flammable material in groove 24 is substantially constant, the time taken by the flame to reach orifice 22 varies according to the depth of the penetration of sliding system 16 into opening 14. This duration substantially corresponds to the time between the ignition of the fuse arranged in chamber 18 and the ignition of the fuse arranged in chamber 20. Accordingly, the deeper sliding system 16 has penetrated into opening 14, the shorter the delay.

Figure 5:
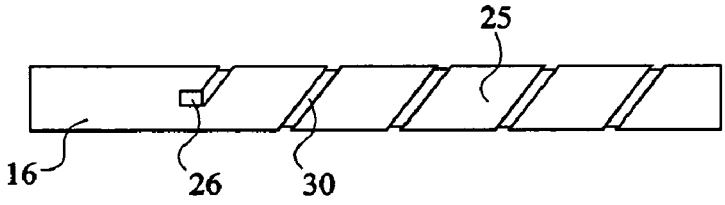
FIG. 5 shows a variation of the element of FIG. 4.

FIG. 5 shows a variation of the first embodiment of device 10 according to the present invention in which the combustion track consists of a groove 30 extending along a helicoid on external wall 25 of sliding system 16 from end 26 where groove 30 emerges into chamber 18 to the opposite end of sliding system 16. Since a helical track has a greater length than a rectilinear track, device 10 according to the present variation enables selection of ignition delays longer than device 10 of FIG. 1.

According to the present variation, sliding system 16 may comprise a helical guiding groove (not shown) interlaced with groove 30 and which, as explained previously, cooperates with the end of a guiding screw. Such a guiding groove shape enables ensuring an adequate positioning of the combustion track with respect to orifice 22.

Figure 6:
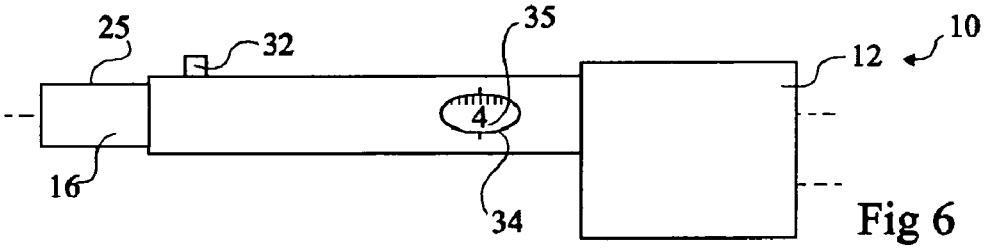
FIG. 6 shows a variation of the device according to the first embodiment.

FIG. 6 shows another variation of the first embodiment. According to this variation, sliding system 16 comprises a pin 32 which substantially extends radially with respect to external wall 25. Guide 12 comprises a groove (not visible in FIG. 6) in which pin 32 can slide. The cooperation of pin 32 and of the groove enables guiding sliding system 16 in its penetration into guide 12. Further, pin 32 is accessible by an operator, and enables easy handling of sliding system 16 in its penetration into guide 12.

According to this variation, guide 12 comprises a port 34 emerging on opening 14 and which exposes external wall 25 of sliding system 16 when said system is placed in opening 34. It is also possible to make inscriptions 35 on external wall 25 of sliding system 16 which are visible by the operator through opening 34. Inscriptions 35 may represent the duration of the delay obtained with device 10 according to the penetration of sliding system 16 into opening 14. As an example, inscriptions 35 in arabic digits may indicate a delay in seconds, and inscriptions in the form of parallel lines may indicate a delay in tenths of a second.

According to another variation of device 10 according to the present invention, external wall 25 of sliding system 16 comprises indentations (not shown) cooperating with a notch (not shown) arranged on the internal wall of opening 14. The indentations enable accurately controlling the penetration of sliding system 16 into opening 14, and also enable ensuring the maintaining in its positing of sliding system 16 in opening 14 once the setting in position has been performed.

According to another variation of the present invention, orifice 22 substantially extends on an arc of a circle to ensure the placing of the combustion track opposite to orifice 22 despite a possible inaccuracy upon placing of sliding system 16 in opening 14.

According to another variation of the present invention, sliding system 16 has a non-cylindrical cross-section, for example, square or triangular, capable of sliding in an opening of a shape complementary to guide 12. Such a shape enables ensuring the guiding of sliding system 16 into opening 14 and the placing of groove 24 with respect to orifice 22 without requiring specific guiding means.

According to another variation of the present invention, sliding system 16 prolongs at one of its ends in a grasping means which remains accessible to an operator, whatever the penetration of sliding system 16 into opening 14, to enable easy handling of sliding system 16.

Figure 7:
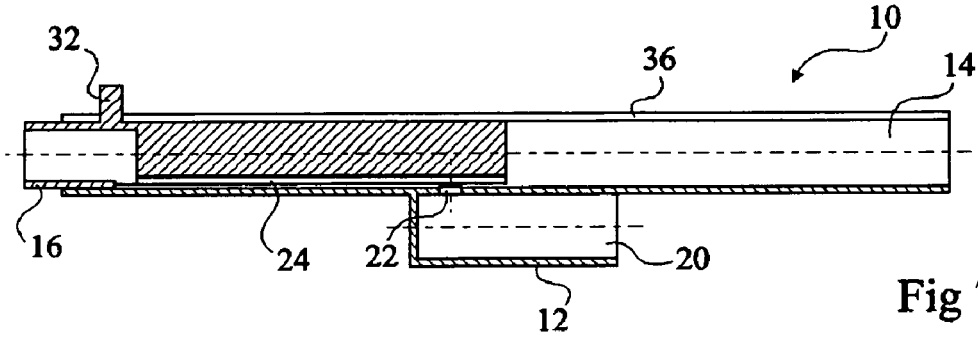
FIG. 7 shows a variation of the device according to the first embodiment.

FIG. 7 shows another variation of the first embodiment. According to this variation, second chamber 20 of guide 12 is arranged substantially in the central portion of opening 14, laterally thereto. Sliding system 16 comprises a pin 32 capable of sliding in a slot 36 extending along a generatrix of guide 12. The axial length of sliding system 16 is substantially equal to half the axial length of opening 14. The operation of the device according to this variation is identical to what has been described hereabove. The main advantage of this variation is that the flammable material arranged in groove 24 of sliding system 16 remains protected by guide 12 whatever the position of sliding system 16 in guide 12.

Figure 8:
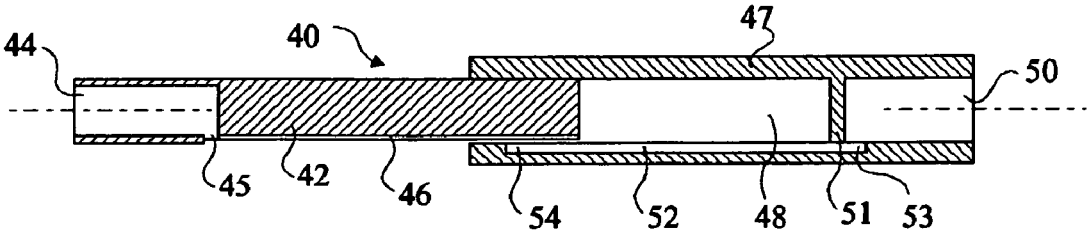
FIG. 8 shows a cross-section view of a second embodiment of the device according to the present invention.

FIG. 8 shows a second embodiment of the present invention in which device 40 comprises a sliding system 42 similar to that of the first embodiment. Sliding system 42, which is substantially cylindrical, comprises at one end a chamber 44 communicating, through an orifice 45, with a groove 46 extending on the external wall of sliding system 42 along a generatrix. Chamber 44 receives the end of one or of several fuses or of one or of several igniters.

Device 40 also comprises a cylindrical guide 47 partially crossed by a cylindrical opening 48 in which sliding system 42 can be displaced. Guide 47 comprises a chamber 50, for example, cylindrical, prolonging opening 48 and separated therefrom by a wall 51. Guide 47 also comprises a groove 52 formed at the level of the internal wall of opening 48, extending along a portion of the generatrix of opening 48, and emerging into chamber 50 through an orifice 53. The internal walls of chambers 44, 50 are covered with a highly-flammable material.

The two grooves 46, 52 are filled with a flammable material similar to the material filling groove 24 for the first embodiment. Sliding system 42 is introduced into opening 48 of guide 47 so that groove 46 covers a portion of groove 52 according to the depth of the penetration of sliding system 42 into guide 47.

When the fuse is ignited or the igniter arranged in chamber 44 is actuated, the flammable material filling groove 46 is ignited at the level of orifice 45. The flame then slowly and regularly propagates in groove 46. When the flame reaches the area where groove 46 starts overlapping groove 52, the flammable material filling groove 52 ignites at end 54 of groove 52. The flame then propagates in groove 52 to reach chamber 50 to ignite the second fuse.

Thereby, according to the depth of the penetration of sliding system 42 in opening 48, the material located at end 54 of groove 52 is ignited faster or slower. The delay provided by device 40 is thus controlled.

Figure 9:
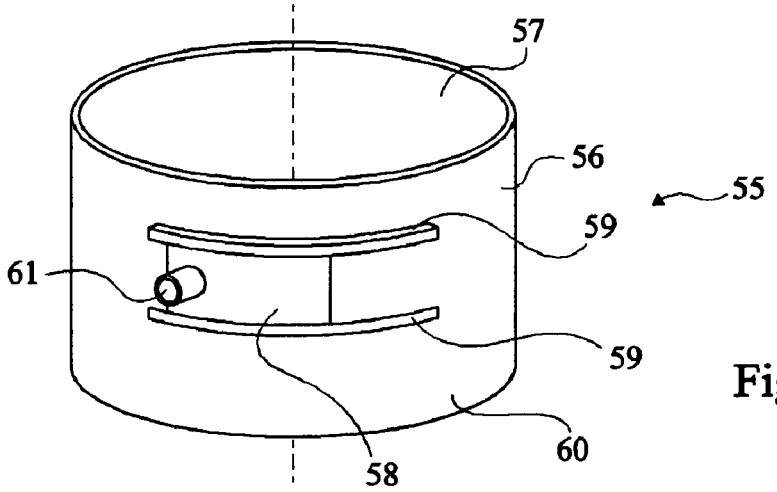
FIG. 9 shows a perspective view of a third embodiment of the device according to the present invention.
Figure 10:
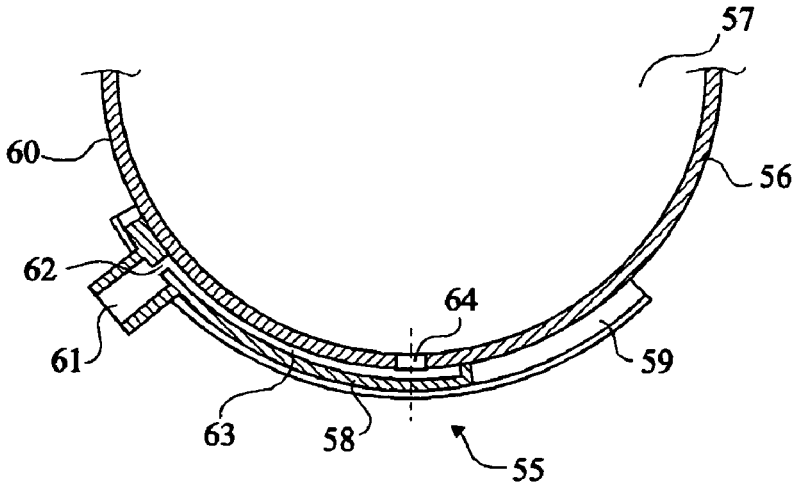
FIGS. 10 and 11 show cross-section views of the device of FIG. 9.
Figure 11:
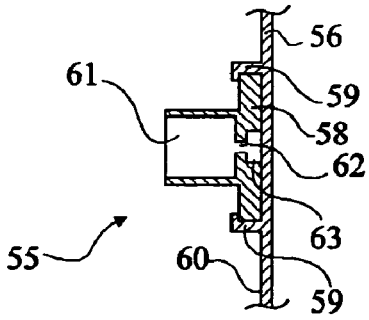

FIGS. 9, 10, and 11 show a third embodiment of the present invention in which device 55 is formed directly on a casing 56 delimiting an inner chamber 57 containing the lift charge of a rocket, of a light fountain, etc. Casing 56 is for example cylindrical. A carriage 58 slides in two rails 59 arranged on outer wall 60 of casing 56 substantially along radiuses. A cylindrical chamber 61 projecting out of carriage 58 receives the end of a fuse or of an igniter.

FIGS. 10 and 11 show a cross-section of a device 55 at the level of chamber 61 respectively along a plane perpendicular to the axis of casing 56 and a plane containing said axis. Chamber 61 communicates through an orifice 62 with an end of a groove 63 formed in carriage 58. A regularly-burning flammable material is arranged in groove 63. Openings (not shown) are provided, for example, at the level of carriage 58, to enable carrying off the gases resulting from the combustion of the flammable material arranged in groove 63.

Casing 56 comprises an orifice 64 creating a communication between groove 63 of carriage 58 and chamber 57 containing the lift charge. Casing 56 is formed, at least in the vicinity of groove 63, of a heat-insulation material.

When the fuse arranged in chamber 61 is ignited or when the igniter is actuated, the flammable material is ignited at the end of groove 63. The flame propagates along groove 63 to reach orifice 64 to ignite the lift charge. By displacing carriage 58 along rails 59, the length of the combustion track separating the end of groove 53 emerging into chamber 61 from orifice 64 is varied. The delay of the lift charge ignition is thus modified.

Devices 55 according to the third embodiment may equip a rocket assembly and be connected to a same ignition fuse. Devices 55 then enable, from a single ignition fuse, igniting with different delays each rocket of the rocket assembly.

According to a variation of the third embodiment cylindrical chamber 61 extends substantially tangentially to casing 56 and is prolonged by groove 63. This enables limiting the radial bulk of the device according to the present invention.

According to a variation of the third embodiment, an auxiliary groove (not shown) communicating with orifice 64 is formed on external wall 60 of casing 56 and filled with a flammable material similar to the material filling groove 63. The auxiliary groove is arranged on casing 56 so that groove 53 covers a larger or smaller portion of the auxiliary groove according to the sliding of carriage 58 with respect to casing 56. When the flammable material is ignited in groove 63 at the level of orifice 62, the flame regularly propagates in groove 63 to reach the auxiliary groove. The flame then propagates in the auxiliary groove to reach orifice 64 to ignite the lift charge.

According to a variation of the third embodiment, casing 56 is formed of a plate intended to be attached, for example, by gluing, on an enclosure containing the lift charge of a rocket, the rest of device 55 being unchanged. The shape of casing 56 is then adapted to the enclosure on which it will be attached. A hole is made in the enclosure, before attachment of device 55, which communicates with orifice 64, once casing 56 has been installed. This variation enables equipping conventional rockets with delay device 55 according to the present invention by modifying the rocket as little as possible. In the case where the material forming the enclosure is sufficiently conductive, it may be unnecessary to pierce the enclosure. Indeed, casing 56 is then formed of a heat insulator so that when the flame reaches orifice 64 which exposes a portion of the enclosure, the generated heat is sufficient to ignite the charge through the enclosure.

Figure 12:
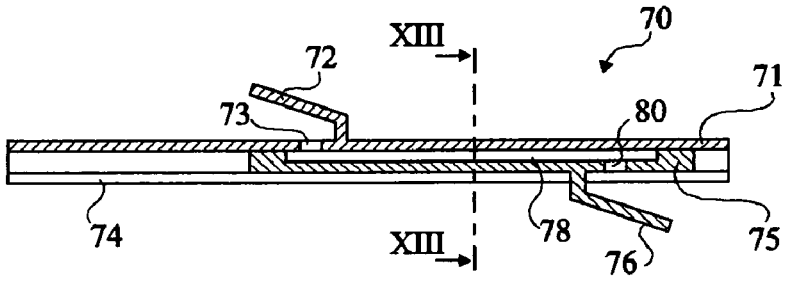
FIG. 12 shows a cross-section view of a fourth embodiment of the device according to the present invention.
Figure 13:
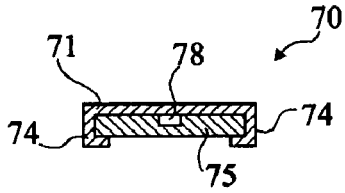
FIG. 13 shows a cross-section of FIG. 12 along lines XIII-XIII.

FIGS. 12 and 13 show a fourth embodiment of the present invention. Device 70 comprises a guide rail 71 having the shape of a substantially parallelepipedal bar on which a first fuse can be attached via a mobile hook 72. An orifice 73 crosses guide rail 71 at the level where the first fuse is attached to guide rail 71. Guide rail 71 prolongs on its two longitudinal edges in two flanges 74 which guide in translation a sliding body 75 having the shape of a substantially parallelepipedal bar. A second fuse may be attached to sliding body 75 on the side of the surface opposite to rail 71 via a mobile hook 76. A groove 78 is formed on the surface of sliding body 75 opposite to rail 71. Groove 78 is, for example, rectilinear and of square cross-section. An orifice 80 crosses sliding body 75 at the level where the second fuse is attached to sliding body 75 and emerges, on the opposite surface, into groove 78. When sliding body 75 is guided in translation by flanges 74, orifice 77 crossing guide rail 71 permanently emerges at the level of groove 78. The regions of guide rail 71 and of sliding body 75 intended to be in contact with the fuses, and orifices 73, 80, are covered with a flammable material. Groove 78 is filled with a flammable material similar to the material filing groove 24 for the first embodiment. Openings are provided at the level of guide rail 71 or of sliding body 75 to enable carrying off gases resulting from the combustion of the flammable material arranged in groove 78. Guide rail 71 has a greater length than sliding body 75 to completely cover the groove, and protect the flammable material that it contains, whatever the position of sliding body 75 with respect to guide rail 71.

When, for example, the first fuse attached at the level of guide rail 71 is ignited, the flame very rapidly propagates to groove 78 through orifice 73. The flame then slowly and regularly propagates in groove 78 to reach orifice 80 and ignite the second fuse. Thereby, according to the relative positions of sliding body 75 and guide rail 71, the portion of groove 78 placed between orifices 73, 80 is modified and the delay provided by device 70 is thus controlled.

The fourth embodiment has the advantage of being of particularly simple design and of exhibiting a reduced bulk.

According to a variation of the fourth embodiment, groove 78 is formed totally or partly on guide rail 71.

Figure 14:
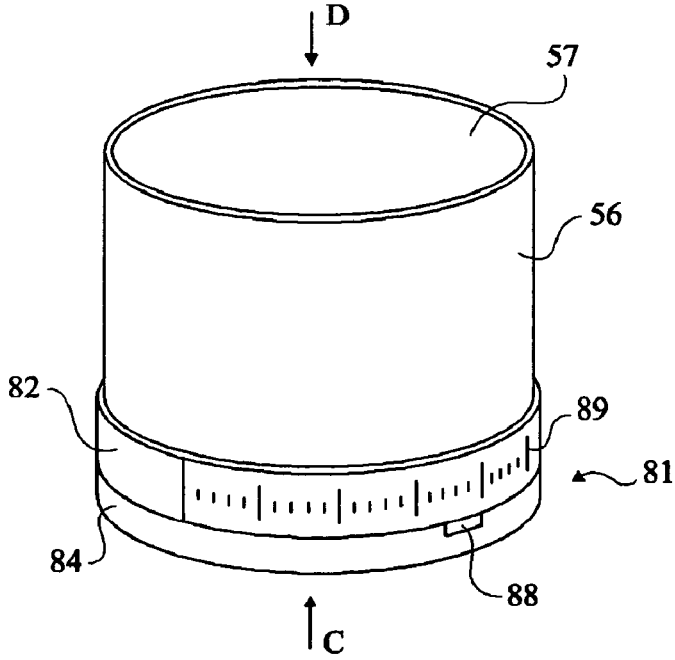
FIG. 14 shows a perspective view of a fifth embodiment of the device according to the present invention.
Figure 15:
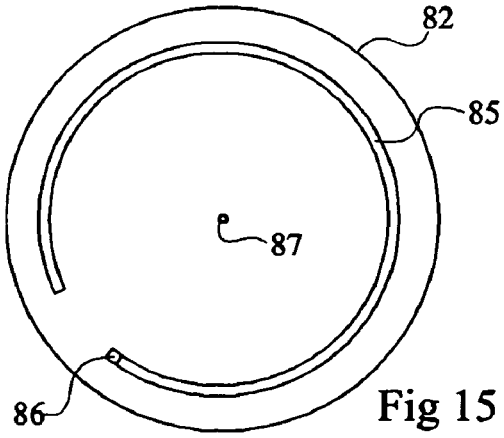
FIG. 15 shows a view of a piece of the device of FIG. 14 along direction C.
Figure 16:
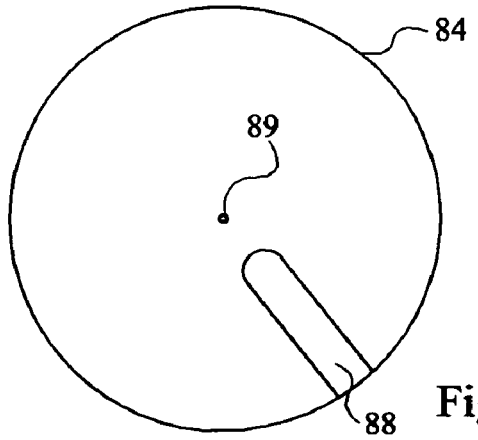
FIG. 16 shows a view of another piece of the device of FIG. 14 along direction D.

FIGS. 14 to 16 show a fifth embodiment of the present invention similar to the third embodiment of the present invention in which device 81 is directly formed on a casing 56 delimiting an inner chamber 57 containing the lift charge of a rocket, of a light fountain, etc. Casing 56 is for example cylindrical. Device 81 comprises an intermediary part 82, cylindrical, fit on casing 56, and covering an open end of casing 56. Intermediary piece 82 is fixed with respect to casing 56 and is sandwiched between casing 56 and a cylindrical base 84. Cylindrical base 84 is coaxial and is rotatably assembled with respect to intermediary part 82.

FIG. 15 shows a view along direction C of setting piece 82. Setting piece 82 comprises a circular groove 85, for example, of square cross-section, which extends on the surface of setting piece 82 opposite to casing 56. Groove 85 follows a circle but does not close back on itself. One end of groove 85 prolongs in an orifice 86 which crosses setting piece 82 to emerge into inner chamber 57 of casing 56. A regularly-burning flammable material is arranged in groove 85 and orifice 86. Intermediary part 82 comprises a threaded hole 87.

FIG. 16 shows a view along direction D of base 84. Base 84 comprises an opening 88 formed on the surface of base 84 in contact with intermediary part 82 and which substantially extends along a radius of base 84 from the lateral edge to the center. Opening 88 receives a fuse or an igniter (not shown). The inside of opening 88 is covered with a flammable material. Base 84 comprises a threaded hole 89 coaxial with threaded hole 87 of intermediary piece 82. A screw (not shown) cooperates with threaded holes 87, 89, and ensures the rotational assembly of base 84 with respect to intermediary piece 82. When base 84 is assembled on intermediary piece 82, opening 88 of base 84 communicates with circular groove 85 of intermediary piece 82. Intermediary piece 82 comprises inscriptions 89 on the lateral edge which indicate the duration of the delay provided by device 81. The delay to be taken into account is that indicated by the inscription located at the level of opening 88. Openings (not shown), for example, at the level of base 84 or of intermediary portion 82, are provided to enable carrying off the combustion gases of the flammable material arranged in groove 85.

When the fuse is ignited or the igniter is actuated in opening 88 of base 84, the flame very rapidly propagates to groove 85. The flame then slowly and regularly propagates in groove 85 to reach orifice 86 and ignite the content of inner chamber 57.

By rotating base 84 with respect to intermediary piece 82, the portion of circular groove 85 placed between opening 88 and orifice 86 is modified and the delay provided by device 81 is thus controlled.

According to a variation of the fifth embodiment groove 85 may be partly or totally formed on base 84.

The device according to the fifth embodiment of the present invention has the advantage of requiring little modifications of the casing on which it is assembled since it replaces the casing bottom. The device according to the present invention has many advantages:

First, it enables obtaining a settable ignition delay.

Second, the ignition delay can be continuously modified since the combustion track, formed at the surface of one or the other of several pieces of the device, permanently communicates with the regions where the fuses, the igniter, or the material to be ignited are arranged, whatever the relative positions between the pieces forming the device.

Third, the combustion track being formed at the surface of one or several parts of the device, the gases resulting from the combustion of the material arranged in the combustion track can be easily carried off, thus ensuring a uniform combustion of the flammable material.

Of course, the present invention is likely to have various alterations and modifications which will readily occur to those skilled in the art. In particular, guide 12 may comprise several chambers 20, each chamber comprising one or several fuses. Sliding system 16 may then comprise several combustion tracks, each track being arrangeable opposite to an orifice communicating with one of the chambers to ignite several fuses with different delays. Further, some of the previously-described variations may be combined, especially with the second embodiment. For example, inscriptions may be made on the external wall of sliding system 42 of device 40 according to the second embodiment of the present invention to indicate the delay provided by device 40 according to the depth of the penetration of sliding system 42 into guide 47.

The invention claimed is:

1. A pyrotechnical device of ignition delay between a fuse or an igniter and a device to be ignited, comprising:

a first element defining a first space receiving at least one fuse or one igniter;

a second element communicating through an orifice with a second space receiving the device to be ignited, the first or second element being able to slide with respect to the second or first element; and a groove formed in the outer surface of the first element and/or the inner surface of the second element, and communicating with the first space through a communicating portion of the first space and with the second space through said orifice irrespective of relative operational positions between the first and the second elements, wherein a regularly burning flammable material is arranged on an external wall of the first element and/or on an internal wall of the second element and contained in said groove, wherein the duration of ignition delay varies according to the groove length between the communicating portion and the orifice, the groove length being defined by relative positions of the first and the second elements.

2. The device of claim 1, wherein the second element is a body comprising a recess forming the second space, and an opening in which is shiftably assembled the first element, said first element comprising a chamber forming the first space, the second space communicating with the opening through the orifice.

3. The device of claim 2, wherein the recess forming the second space is arranged laterally to the opening, and wherein the groove communicates at one end with the chamber through a hole and is placed opposite to the orifice.

4. The device of claim 2, wherein the recess forming the second space is arranged in prolongation of the opening, and wherein the groove communicates at on end with the chamber through a hole and wherein the device further comprises a second groove filled with the flammable material arranged on the inner wall of the opening and communicating at one end with the second space through the orifice, the groove being placed opposite to the second groove.

5. The device of claim 2, wherein inscriptions are made on the external wall of the first element, the body comprising a port emerging on the opening and exposing part of the inscriptions as the first element moves in the opening.

6. The device of claim 2, wherein the chamber can further be rotated with respect to the second element.

7. The device of claim 1, wherein the first element and the second element are at least partly parallelepipedal and are shiftably assembled with respect to each other, a planar surface of the first element at least partially facing a complementary planar surface of the second element, the groove being formed of at least one rectilinear groove filled with the flammable material arranged on the planar surface or the complementary planar surface.

8. The device of claim 1, comprising a carriage, comprising a chamber defining the first space, said carriage being capable of sliding in rails arranged on the wall of a casing containing the second space, the orifice crossing the casing wall, the groove being formed of at least one groove formed on the carriage, containing the flammable material and communicating through a hole with the chamber and connected to the orifice.

9. The device of claim 1, wherein the device to be ignited is an enclosure containing a combustion material, and wherein the second element comprises a wall crossed by the orifice and intended to be attached to the enclosure, the first element being formed of a carriage, comprising a chamber forming the first space, capable of sliding in rails arranged on the wall the side opposite to the enclosure, the groove being formed of at least one groove formed on the carriage, containing the flammable material and communicating through a hole with the chamber and connected to the orifice.

10. The device of claim 1, wherein the device to be ignited is an enclosure containing a combustion material, and in which the second element comprises a fixed plate, crossed by the orifice and intended to be attached to the enclosure, the first element comprising a mobile plate rotatably assembled on the fixed wall on the side opposite to the enclosure, the mobile plate comprising an opening forming the first space, the groove being formed of at least one at least partly circular groove, containing the flammable material, formed on the fixed plate on the side opposite to the enclosure, prolonging by the orifice, and having a portion communicating with the opening.

* * * * *